US009368266B2

(12) United States Patent
Maller et al.

(10) Patent No.: US 9,368,266 B2
(45) Date of Patent: Jun. 14, 2016

(54) ELECTRIC SOLENOID STRUCTURE HAVING ELASTOMERIC BIASING MEMBER

(71) Applicant: Trumpet Holdings, Inc., Milwaukee, WI (US)

(72) Inventors: Dennis A. Maller, Racine, WI (US); David Lee Westfall, Germantown, WI (US)

(73) Assignee: Trumpet Holdings, Inc., Milwaukee, WI (US)

( * ) Notice: Subject to any disclaimer, the term of this patent is extended or adjusted under 35 U.S.C. 154(b) by 63 days.

(21) Appl. No.: 14/334,750

(22) Filed: Jul. 18, 2014

(65) Prior Publication Data

US 2016/0020010 A1 Jan. 21, 2016

(51) Int. Cl.

| | |
|---|---|
| ***H01H 3/00*** | (2006.01) |
| ***H01F 7/16*** | (2006.01) |
| ***F02N 11/08*** | (2006.01) |

(52) U.S. Cl.

CPC ..... *H01F 7/1607* (2013.01); *F02N 11/087* (2013.01)

(58) Field of Classification Search

CPC ..... H01H 36/00; H01H 50/02
USPC ..... 335/185
See application file for complete search history.

(56) References Cited

U.S. PATENT DOCUMENTS

| | | | |
|---|---|---|---|
| 810,490 | A | 1/1906 | Knupp et al. |
| 1,269,564 | A | 6/1918 | Henderson |
| 1,361,935 | A | 12/1920 | Villiers |
| 1,518,020 | A | 12/1924 | Traver |
| 1,668,752 | A | 5/1928 | Anderson |
| 1,857,349 | A | 5/1932 | Boehm |
| 1,944,582 | A | 1/1934 | Snyder |
| 2,212,798 | A | 8/1940 | Sole |
| 2,271,326 | A | 1/1942 | Bird |
| 2,355,477 | A | 8/1944 | Stahl |
| 2,444,118 | A | 6/1948 | Snyder |
| 2,540,185 | A | 2/1951 | Brown |
| 2,560,444 | A | 7/1951 | Jackson et al. |

(Continued)

FOREIGN PATENT DOCUMENTS

| | | |
|---|---|---|
| EP | 0721650 | 1/1999 |
| GB | 819376 | 9/1959 |

(Continued)

OTHER PUBLICATIONS

Article: "MV Vacuum Switchgear based on Magnetic Actuators", Trends in Disbribution Switchgear, Nov. 1998, pp. 85-90.

(Continued)

*Primary Examiner* — Shawki S Ismail
*Assistant Examiner* — Lisa Homza
(74) *Attorney, Agent, or Firm* — Ryan Kromholz & Manion, S.C.

(57) ABSTRACT

An apparatus and method directed to the art of providing an electrically insulative electric solenoid for starting internal combustion engines are provided. The solenoid has a housing; a coil unit within the housing comprising a hollow can with an open end, and a bobbin, an armature, and a bridging contact assembly positioned in the can; a flux washer abutting the open end of the can; a mounting plate abutting the open end of the housing, and an electrically insulative biasing member positioned between the mounting plate and the flux washer and between the mounting plate and the bobbin.

20 Claims, 4 Drawing Sheets

(56) References Cited

U.S. PATENT DOCUMENTS

| | | | | |
|---|---|---|---|---|
| 2,708,245 | A | 5/1955 | Werner | |
| 2,782,282 | A | 2/1957 | Schrack | |
| 2,787,743 | A | 4/1957 | Hultgren | |
| 2,915,681 | A | 12/1959 | Troy | |
| 3,010,055 | A | 11/1961 | Nicolaus | |
| 3,070,730 | A | 12/1962 | Gray et al. | |
| 3,083,930 | A | 4/1963 | Brekke | |
| 3,103,603 | A | 9/1963 | Reutter | |
| 3,185,948 | A | 5/1965 | Helberg | |
| 3,194,918 | A | 7/1965 | Muscante et al. | |
| 3,238,329 | A | 3/1966 | Russo | |
| 3,260,824 | A | 7/1966 | Schleicher | |
| 3,272,949 | A | 9/1966 | Lawrence | |
| 3,308,412 | A | 3/1967 | Curtis et al. | |
| 3,457,534 | A | 7/1969 | Davis | |
| 3,473,898 | A | 10/1969 | Maxfield | |
| 3,486,352 | A | 12/1969 | Bouthors et ai. | |
| 3,552,627 | A | 1/1971 | Moreno | |
| 3,597,562 | A | 8/1971 | Turnbull | |
| 3,605,055 | A | 9/1971 | Grady | |
| 3,606,195 | A | 9/1971 | Freeman, Jr. et al. | |
| 3,661,342 | A | 5/1972 | Sears | |
| 3,683,239 | A | 8/1972 | Sturman | |
| 3,688,230 | A | 8/1972 | Tichy | |
| 3,689,856 | A | 9/1972 | Lambert et al. | |
| 3,731,245 | A | 5/1973 | Roslin | |
| 3,743,898 | A | 7/1973 | Sturman | |
| 3,747,379 | A | 7/1973 | Cabanes | |
| 3,755,766 | A | 8/1973 | Read, Jr. | |
| RE27,891 | E | 1/1974 | Davis | |
| 3,792,390 | A | 2/1974 | Boyd | |
| 3,828,288 | A | 8/1974 | Boyd | |
| 3,848,206 | A | 11/1974 | Prouty et al. | |
| 3,857,068 | A | 12/1974 | Braunstein | |
| 4,004,258 | A | 1/1977 | Arnold | |
| 4,029,916 | A | 6/1977 | Chu | |
| 4,046,244 | A | 9/1977 | Velazquez | |
| 4,052,580 | A | 10/1977 | Stanish | |
| 4,072,918 | A | 2/1978 | Read, Jr. | |
| 4,086,553 | A | 4/1978 | Robandt et al. | |
| 4,127,835 | A | 11/1978 | Knutson | |
| 4,131,866 | A | 12/1978 | Torr | |
| 4,142,169 | A | 2/1979 | Katchka et al. | |
| 4,144,514 | A | 3/1979 | Rinde et al. | |
| 4,153,890 | A | 5/1979 | Coors | |
| 4,166,265 | A | 8/1979 | Reynolds et al. | |
| 4,209,820 | A | 6/1980 | Rundel et al. | |
| 4,218,669 | A | 8/1980 | Hitchcock et al. | |
| 4,253,493 | A | 3/1981 | English | |
| 4,274,136 | A | 6/1981 | Onodera et al. | |
| 4,285,603 | A | 8/1981 | Bernardis et al. | |
| 4,293,835 | A * | 10/1981 | Davis | H01H 71/04 335/126 |
| 4,306,207 | A | 12/1981 | Tada et al. | |
| 4,315,197 | A | 2/1982 | Studer | |
| 4,363,014 | A | 12/1982 | Leach et al. | |
| 4,382,242 | A | 5/1983 | Colvin et al. | |
| 4,383,234 | A | 5/1983 | Yatsushiro et al. | |
| 4,419,643 | A | 12/1983 | Ojima et al. | |
| 4,446,449 | A | 5/1984 | Brown | |
| 4,449,691 | A | 5/1984 | Fuhrer | |
| 4,462,016 | A | 7/1984 | Bland et al. | |
| 4,463,332 | A | 7/1984 | Everett | |
| 4,509,026 | A | 4/1985 | Matsushita | |
| 4,521,758 | A * | 6/1985 | Krubsack | H01H 51/065 335/126 |
| 4,604,597 | A | 8/1986 | Bogner et al. | |
| 4,621,660 | A | 11/1986 | Klocke | |
| 4,634,819 | A | 1/1987 | Ikeda | |
| 4,635,016 | A | 1/1987 | Guery et al. | |
| 4,660,011 | A | 4/1987 | Reiter | |
| 4,683,452 | A | 7/1987 | Henley | |
| 4,706,037 | A | 11/1987 | Prouty et al. | |
| 4,739,945 | A | 4/1988 | Yokoe | |
| 4,766,405 | A | 8/1988 | Daly et al. | |
| 4,779,582 | A | 10/1988 | Lequesne | |
| RE32,783 | E | 11/1988 | Clark | |
| 4,860,158 | A | 8/1989 | Brown | |
| 4,896,127 | A | 1/1990 | Hida | |
| 5,021,760 | A * | 6/1991 | Krubsack | H01H 50/20 335/196 |
| 5,032,812 | A | 7/1991 | Banick et al. | |
| 5,119,260 | A | 6/1992 | Huhse et al. | |
| 5,127,624 | A | 7/1992 | Domke | |
| 5,132,653 | A * | 7/1992 | Nakatake | H01H 51/065 200/293 |
| 5,268,662 | A | 12/1993 | Uetsuhara et al. | |
| 5,303,560 | A | 4/1994 | Hanson et al. | |
| 5,428,330 | A * | 6/1995 | Tamemoto | H01H 51/065 335/236 |
| 5,470,043 | A | 11/1995 | Marts et al. | |
| 5,497,135 | A | 3/1996 | Wisskirchen et al. | |
| 5,521,566 | A * | 5/1996 | Krubsack | H01H 51/065 335/126 |
| 5,598,625 | A | 2/1997 | Bluen et al. | |
| 5,600,294 | A | 2/1997 | Buenconsejo et al. | |
| 5,663,700 | A | 9/1997 | Spence et al. | |
| 5,734,310 | A | 3/1998 | Ankney et al. | |
| 5,774,036 | A | 6/1998 | Hrytzak et al. | |
| 5,804,962 | A | 9/1998 | Kather et al. | |
| 5,815,364 | A | 9/1998 | Hurley et al. | |
| 5,912,604 | A | 6/1999 | Harvey et al. | |
| 6,009,615 | A | 1/2000 | McKean et al. | |
| 6,031,443 | A | 2/2000 | Larsen | |
| 6,073,869 | A | 6/2000 | Schulz | |
| 6,179,268 | B1 | 1/2001 | Seid | |
| 6,182,942 | B1 | 2/2001 | Kadlicko | |
| 6,229,421 | B1 | 5/2001 | Floyd et al. | |
| 6,246,131 | B1 | 6/2001 | Sheng | |
| 6,401,976 | B1 | 6/2002 | Estelle et al. | |
| 6,598,824 | B2 | 7/2003 | Schmidt | |
| 6,791,442 | B1 | 9/2004 | Schmidt | |
| 6,873,514 | B2 | 3/2005 | Maller et al. | |
| 2005/0190024 | A1 * | 9/2005 | McMahon | H01H 1/5855 335/126 |
| 2008/0303617 | A1 * | 12/2008 | Schmidt | F02N 11/10 335/156 |
| 2013/0106544 | A1 * | 5/2013 | Schmidt | H01H 51/06 335/202 |

FOREIGN PATENT DOCUMENTS

| | | |
|---|---|---|
| GB | 2112212 | 7/1982 |
| GB | 2289374 | 11/1995 |
| JP | 55-36973 | 3/1980 |
| WO | WO 82/03944 | 11/1982 |
| WO | WO 95/07542 | 3/1995 |

OTHER PUBLICATIONS

Web page: Brian McKean Associates, Aug. 28, 2000, 6 pages.

Article: "Fast-Acting Long-Stroke Bistable Solenoids with Moving, Permanent Magnets", Transactions on Industry Applications, vol. 26, No. 3, May/Jun. 1990, pp. 401-406 + 2 pgs.

Article: "Magnets & Vacuum—The Perfect Match", Trends in Distribution Switchgear, Nov. 1998, pp. 73-79.

Article: "Computer Aided Optimal Design of Magnetic Actuator for Autoreclosure Application", Authors; Renforth, Auckland Varlow, pp. 80-85, date unknown (no date).

* cited by examiner

ELECTRIC SOLENOID STRUCTURE HAVING ELASTOMERIC BIASING MEMBER

BACKGROUND OF THE INVENTION

This invention relates to a solenoid for selectively closing the connection between a pair of fixed terminals, with one particular application being the energizing of electric starter motors used in various internal combustion engine driven devices. In addition to automobiles and trucks, other labor saving devices such as lawn mowers, garden tractors, and snow blowers, and recreational vehicles, such as all-terrain vehicles, snowmobiles, and motorcycles powered by an internal combustion engine. The lower horsepower engines may be provided with a manual starter unit or a motor-driven electric starter unit. If an electric starter unit is provided, a solenoid is used to complete the starting circuit from the battery to the starting motor. The solenoid is controlled by a remote start circuit. In these low horsepower engine applications, the total cost of the device does not permit the use of a relatively large and expensive solenoid structure as used on automobiles and like vehicles.

Although the solenoid should be of a relatively inexpensive construction, the rather severe weather conditions and high levels of vibration and shock require the solenoid be ruggedly built to provide economic durability. The solenoid structure should be as compact as practical due to the relatively confined space in the engine compartment.

It is also preferable to employ fewer parts in construction of the solenoid, as fewer parts mean lower cost, lower failure rates, and greater consistency in the quality of manufacture, all the while maintaining or improving performance.

Although various units have been suggested, there is a distinct need for a small, compact and relatively inexpensive solenoid for use in engine starters and other applications.

U.S. Pat. No. 4,521,758, owned by the same assignee is incorporated herein by reference.

SUMMARY OF THE INVENTION

The present invention is directed to a small, compact and relatively inexpensive solenoid adapted for electric starter motors used on low horsepower internal combustion engine applications. The present invention is particularly described in connection with application as a starter solenoid, but the present invention may of course be used in applications where a low power circuit controls a high power circuit.

One aspect of the invention provides a solenoid unit with hollow open-ended housing; a coil assembly housed in the housing comprising a cup-shaped can, a bobbin with a center tube and an outward projection extending outwardly coaxially from the center tube, an armature within the bobbin, and a flux washer abutting the open end of the cup-shaped can; at least a portion of the bobbin outward projection extending through the flux washer and beyond the open end of the housing; a bridging contact assembly comprising a contact actuation pin and a bridging contact affixed to the contact actuation pin operatively connected to the coil assembly opposite the bobbin outward projection; a mounting plate affixed to the open end of the housing; a biasing member having a body with a first surface, a second surface opposite the first surface, a cavity extending inwardly from the first surface towards the second surface, and a leg extending outwardly from the body second surface; the bobbin outward projection received within the biasing member cavity; and the biasing member positioned between the mounting plate and the flux washer with the biasing member leg abutting the mounting plate and the biasing member first surface abutting the flux washer.

The biasing member may have at least two legs extending from the second surface. The biasing member may have at least three legs extending from the second surface. The biasing member may be non-metallic. The biasing member may be electrically insulative.

The biasing member may also have a peripheral surface about the periphery of the body between the first surface and the second surface and a protrusion extending outwardly from the peripheral surface.

The biasing member may have at least two projections extending from the peripheral surface. The biasing member may have at least three projections extending from the peripheral surface.

The solenoid may also have a sealing gasket positioned between the mounting plate and the open end of the housing.

Another aspect of the present invention provides an improved solenoid unit having a housing; a coil assembly with a can, a bobbin with a center tube and an outward projection, an armature within the bobbin, and a flux washer at the open end of the can; a mounting plate attached to the housing; and a sealing gasket between the housing and the mounting plate, wherein the improvement includes a biasing member having a circular body with a first planar surface, a second planar surface opposite and substantially parallel with the first planar surface, and a peripheral surface extending between the first and second planar surfaces about the periphery of the circular body; a circular cavity extending from the first planar surface towards the second planar surface terminating in an abutment surface and further defining a collar surface about the periphery of the circular cavity; a leg extending outward from the second planar surface; and a protrusion extending radially outward from the body peripheral surface; whereby the first surface extends outward across one end of the protrusion; whereby the biasing member is positioned with the leg in contact with the mounting plate, the outward projection of the bobbin received within the biasing member circular cavity, the projecting member extending through the sealing gasket, and the first planar surface in contact with the flux washer.

The biasing member may have at least two legs extending from the second surface. The biasing member may have at least three legs extending from the second surface. The biasing member may be non-metallic. The biasing member may be electrically insulative.

The biasing member may have at least two projections extending from the peripheral surface. The biasing member may have at least three projections extending from the peripheral surface.

Another aspect of the present invention provides a method for retaining a coil assembly within a solenoid housing and reducing the potential for electricity to pass through the solenoid to the object on which the solenoid is mounted, the method comprising the steps of providing a solenoid having a hollow housing with an open end; a coil assembly housed in the housing comprising a cup-shaped can, a bobbin with a center tube and an outward projection extending outwardly coaxially from the center tube, an armature within the bobbin, and a flux washer abutting the open end of the cup-shaped can; wherein a portion of the bobbin outward projection extends through the flux washer and beyond the open end of the housing; a bridging contact assembly comprising a contact actuation pin and a bridging contact affixed to the contact actuation pin operatively connected to the coil assembly opposite the bobbin outward projection; and a mounting plate affixed to the open end of the housing; providing a non-metallic insulative biasing member having a body with a first surface, a second surface opposite the first surface, a cavity extending inwardly from the first surface towards the second surface, and a leg extending outwardly from the body second surface; positioning the bobbin outward projection within the biasing member cavity; and positioning the biasing member between the mounting plate and the flux washer with the biasing member leg abutting the mounting plate and the biasing member first surface abutting the flux washer.

The biasing member may have a peripheral surface about the periphery of the body between the first surface and the second surface and a protrusion extending outwardly from the peripheral surface. The biasing member may have at least two projections extending from the peripheral surface.

The biasing member may have at least two legs extending from the second surface.

DESCRIPTION OF THE PREFERRED EMBODIMENT

Figure 1:
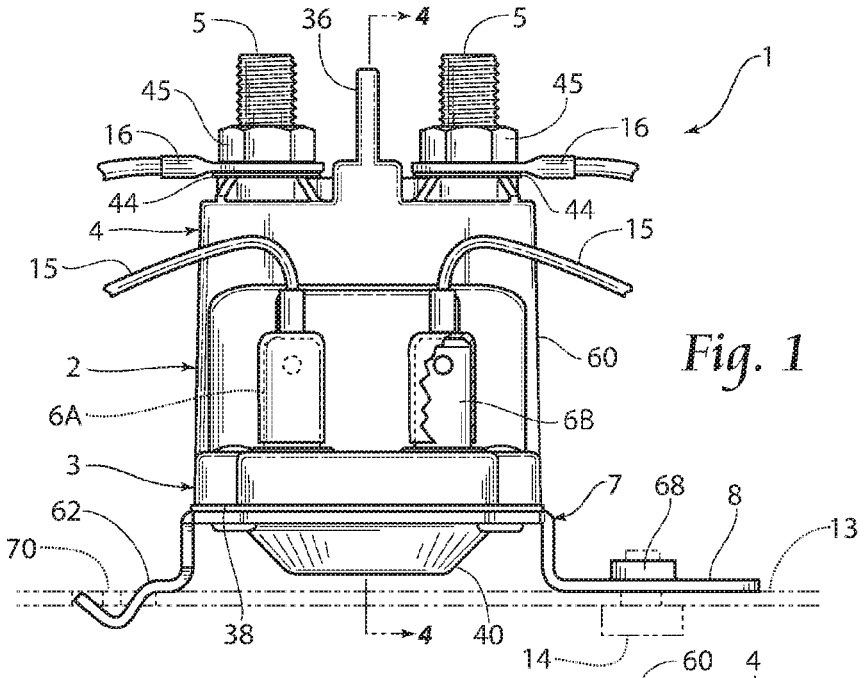
FIG. 1 is a side view of a solenoid according to the present invention.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Referring to the drawings and particularly to FIGS. 1-5 and 10, a solenoid 1 according to the present invention is illustrated. The solenoid 1 preferably comprises an outer housing 60; a pair of fixed power terminals 5; a coil assembly 9 and a bridging contact unit 11 substantially housed within the housing 60 (see FIGS. 4 and 5); a first coil terminal 6A; a second coil terminal 6B; a sealing gasket 38; a biasing member 100 (see FIGS. 6-9); and a mounting plate 7.

The housing is preferably formed with a hexagonal coil section 2 integrally formed to a mounting base or flange 3 on one end and an outwardly projecting rectangular contact section 4 to the opposite or upper end according to the orientation of the solenoid 1 in the drawings.

The pair of fixed power terminals 5 are preferably secured to the upper end wall 28 of the contact housing section 4. The power terminals 5 may be any thread size and length and/or comprised of any other suitable electrical connecting device, and are preferably comprised of conductive copper.

The inner head 43 of the bolt 5 is generally trilobular with outer curved edges and mates with a corresponding recess in the outer end wall of the rectangular section 4. The terminal bolt 5 is pressed in place and projects outwardly with a suitable clamping nut 44 for fixed mounting of the terminal in place. Preferably, the clamping nut 44 is a PALNUT® fastener; however, similar fasteners are contemplated. A power lead 16 is clamped between the clamping nut 44 and an outer connecting nut 45.

Figure 4:
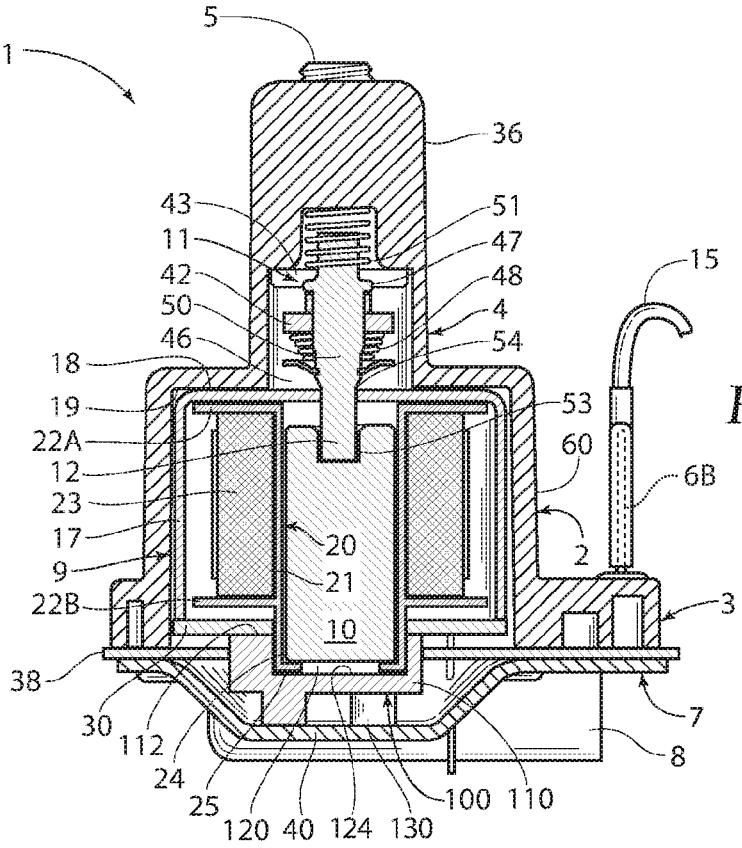
FIG. 4 is a cross-sectional view of the solenoid along line 4-4 of FIG. 1.
Figure 5:
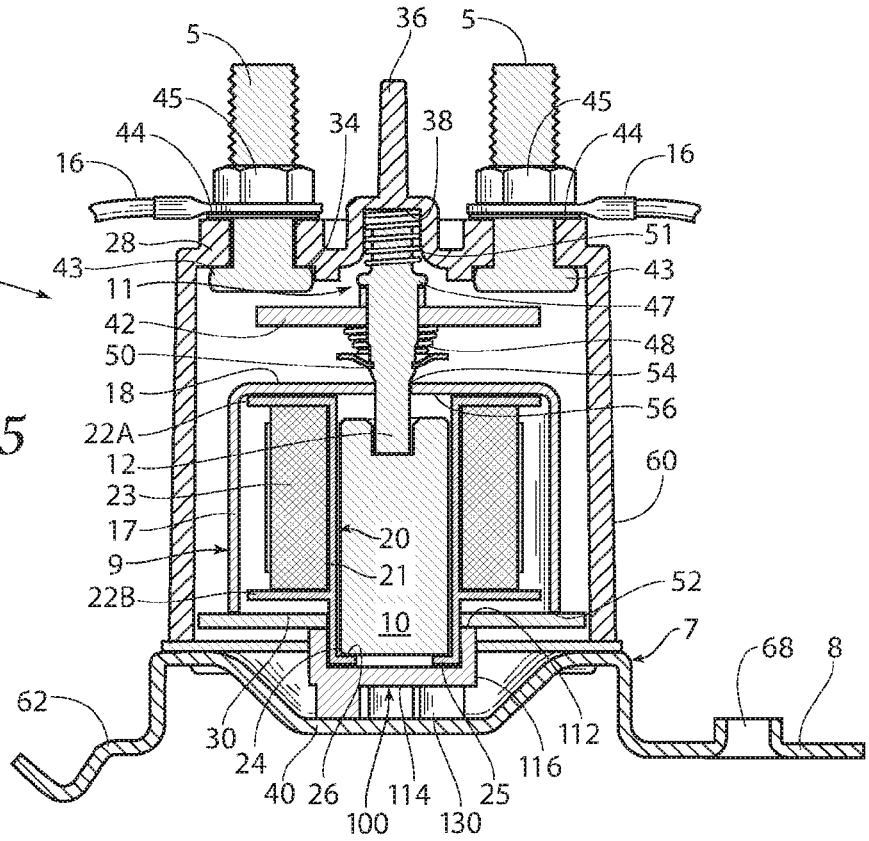
FIG. 5 is a cross-sectional view of the solenoid along line 5-5 of FIG. 2.
Figure 6:
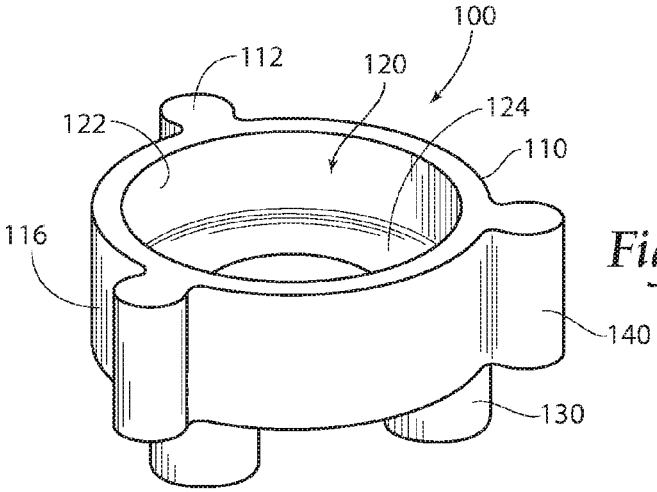
FIG. 6 is a perspective view of a biasing member according to the present invention.
Figure 7:
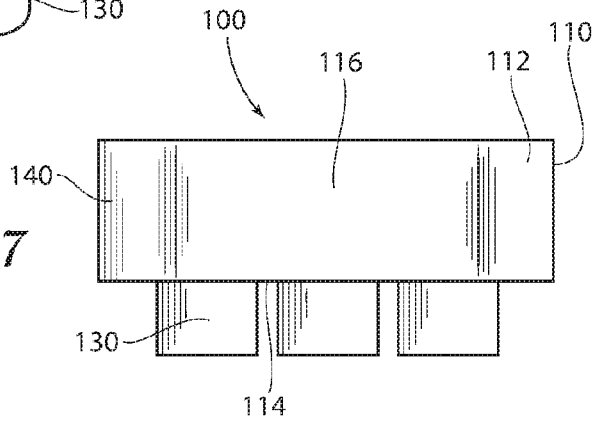
FIG. 7 is a side view of the biasing member shown in FIG. 6.
Figure 8:
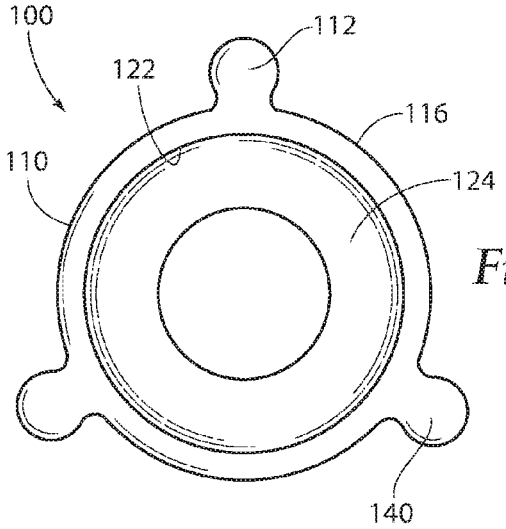
FIG. 8 is a top view of the biasing member shown in FIG. 6.
Figure 9:
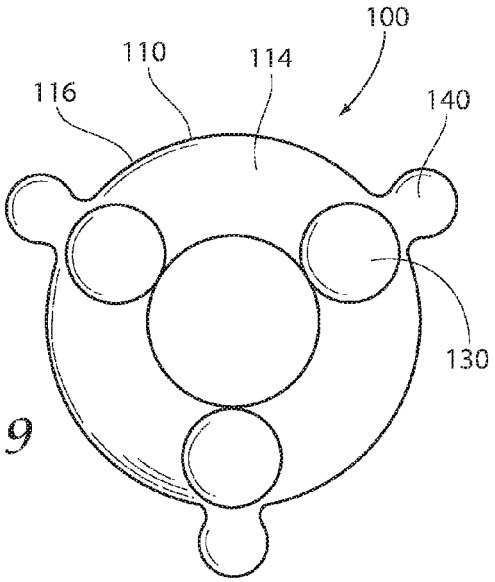
FIG. 9 is a bottom view of the biasing member shown in FIG. 6.
Figure 10:
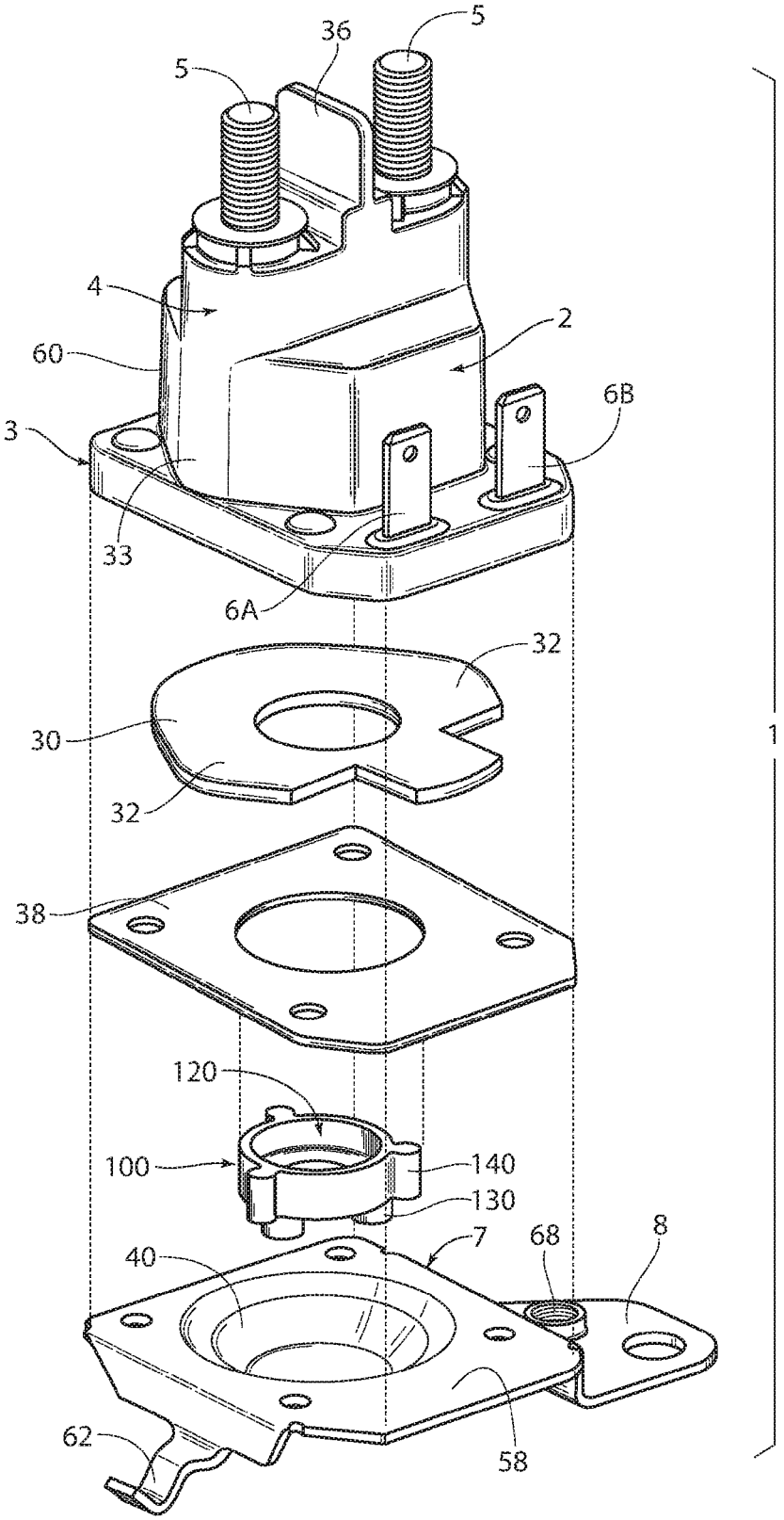
FIG. 10 is a partially exploded view of the solenoid shown in FIG. 1.

The hexagonal-shaped coil section 2 is formed with the six side walls having opposed side walls spaced a distance corresponding to the external diameter of the annular coil assembly 9 (see FIGS. 4 and 5). The coil section 2 is also formed with a depth generally corresponding to the depth of the coil assembly 9.

Figure 2:
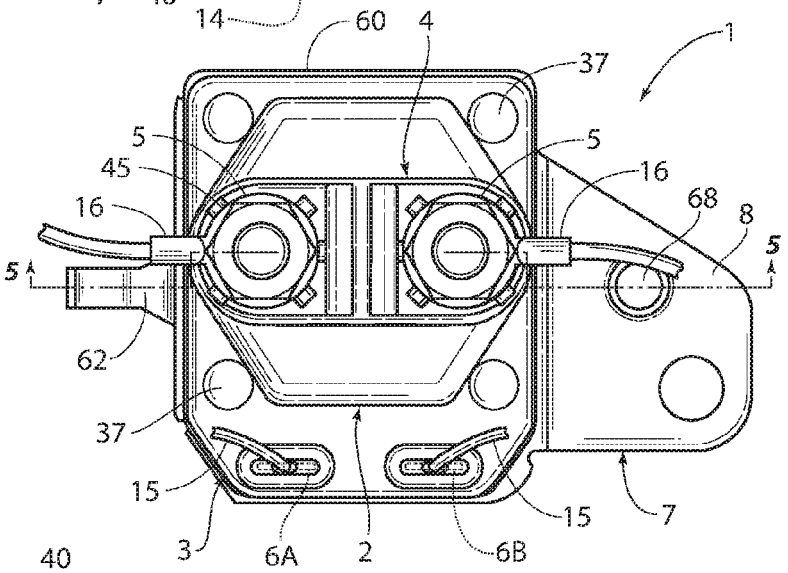
FIG. 2 is a top view of the solenoid shown in FIG. 1.
Figure 3:
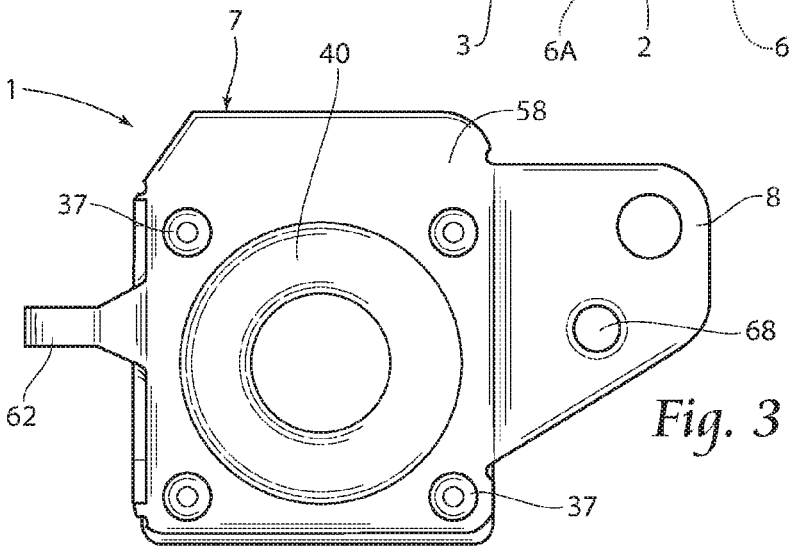
FIG. 3 is a bottom plan view of the solenoid shown in FIG. 1.

The mounting base 3 of the housing 60 is shown as a flat, rectangular portion with the opposite ends extending outwardly of the hexagonal coil section 2, as most clearly shown in FIG. 2.

The first and second coil terminals 6A, 6B preferably extend upward from the mounting base 3 and comprises a male-spade-type electrical connector; however, any other type of connector, including but not limited to a conventional threaded bolt-type member, are contemplated.

The rectangular contact section 4 preferably has an internal rectangular cross-section with the longer length aligned with the power terminals 5. The rectangular section 4 preferably defines a guide opening 46 extending outwardly of the end wall 19 of the coil section 2. The lateral or outer edges of the rectangular section 4 are preferably formed as generally curved shaped portions and as an extension of the hexagonal walls of the section 2 as shown in FIGS. 1 and 2.

The housing 60 is preferably formed with an open bottom at the flange 3, which is closed by a mounting plate 7. The mounting plate 7, shown from the side in FIG. 1 and the bottom in FIG. 3, preferably has a flat rectangular portion 58, a mounting ear 8, a tang 62, and a center portion 40. The mounting ear 8 (as viewed from the side in FIG. 1) extends outward from, and is offset from, the rectangular portion 58 and comprises a hole 68 for convenient bolting of the solenoid 1 to the frame 13 of the vehicle or other implement with a bolt 14. The tang 62 extends outward and offset from the center portion 40 opposite the mounting ear 8 and is configured to hook into a recess 70 in the frame 13. The center portion 40 is preferably dished to provide an outwardly projecting chamber of a lesser depth than the mounting ear 8 and the tang 62.

The mounting plate 7 is preferably affixed to the mounting flange 3 by four rivets 37 installed on the four corners of the rectangular portion 58 of the mounting plate 7 and the mounting flange 3.

A sealing gasket 38 is preferably disposed between the mounting plate 7 and the mounting flange 3 to provide a substantially liquid-tight seal of the housing 60, and particularly to prevent liquid from contacting the coil assembly 9 and the internal contact assembly 11.

With reference to FIGS. 4 and 5, the inside of the solenoid 1 may be seen. The coil assembly 9 is preferably an annular assembly including an outer cup-shaped can 17, a bobbin 20 and an armature 10 housed substantially in the can 17, and a flux washer 30 positioned at the open end of the can 17. The can 17 and the flux washer are preferably formed of a suitable magnetic flux carrying material, such as a conventional type of steel.

The can 17 has a base 18, an aperture 54 in the base 18, and an outer end surface 52 opposite the base 18. The can 17 preferably has a depth generally corresponding to the depth of the housing coil section 2 and is assembled with the base 18 of the can abutting the inner ledge 19 defined by the common wall connection of the coil section 2 and the contact section 4.

The insulating bobbin 20 has a center tube 21 and opposite end flanges 22A, 22B which define an annular recess within which the winding 23 is wound. The center tube 21 includes an outward projection 24 which projects outwardly away from the can 17 and defines an elongated chamber within which the cylindrical armature 10 is slidably disposed.

The armature 10, preferably in the form of a solid plunger or cylinder, is slidably mounted within the center tube 21 and outward projection 24 of the bobbin 20.

The flux washer 30 preferably includes ear portions 32 (FIG. 10) extended outwardly of the principle diameter of the flux washer 30 on opposite sides of the flux washer 30. Each opposed ear portion 32 is preferably located in the corner 33 of two of the side walls of the hexagonal coil section 2. The configuration provides angular orientation of the coil assembly 9 within the hexagonal coil section 2 in a given angular orientation and reduces angular movement within the housing 60.

A bridging contact unit or assembly 11 is located within the upper contact section 4 and includes a contact actuation pin 12 coupled to the armature 10 for vertical movement of the contact assembly 11. The fixed terminals 5 are exposed within the housing section 4 for selective engagement by the outwardly or upwardly moving bridging contact unit 11.

The contact assembly 11 preferably has a bridging contact 42 formed of a highly conductive material such as copper. The bridging contact 42 is secured to the contact actuation pin 12 for selective positioning with respect to the fixed power terminals 5.

The contact actuation pin 12 is preferably formed of a non-magnetic metal, more preferably brass; however, other non-magnetic metals are contemplated. The contact actuation pin 12 has an enlarged clamping flange 47 adjacent the rectangular contact section end wall 28. The bridging contact 42 is located on the contact actuation pin 12 with small coil spring 48 located between the bridging contact 42 and a holding washer 50 which is press-fit or otherwise secured to the contact actuation pin 12 to support the assembly.

The contact actuation pin 12 extends from such holding washer 50 through the aperture 54 in the magnetic can 17 and into a pocket 53 in the solenoid armature 10. A bias stabilizing spring 51 is located between the clamping flange 47 of the contact actuation pin 12 and a base wall 38 of the rectangular section 4. The spring 51 resiliently urges the contact assembly 11 into engagement with the armature 10. The force of the spring 51 is sufficiently great to stabilize the location of the contact assembly.

The end wall 28 of the rectangular section 4 is preferably a relatively thick wall, with an inner surface 34 recessed to accommodate the head of the terminal bolts 5 and with an insulating section 36 therebetween. The insulating section 36 is also preferably recessed to accommodate the small stabilizing spring 51 which acts between the base wall 38 and contact actuation pin 12.

The armature 10 is preferably a solid cylindrical member comprised of a flux conducting material and journaled in the tube 21 of the bobbin 20. When the coil 23 is energized, an electromagnetic interaction is created between the coil 23 and the armature 10 and the armature moves within the tube 21 from the internal surface 26 of the shoulder portion 25 to the inside surface 56 of the base 18 of the magnetic can 17. The movement of the armature 10 correspondingly positions the contact assembly 11 for opening and closing the circuit assembly without unnecessary loading of the solenoid armature.

The biasing member 100 preferably has a circular body 110, a circular cavity 120, at least one leg 130, and at least one protruding member 140. The body 110 comprises a first surface 112, a second surface 114 opposite and substantially parallel with the first surface 112, and a peripheral surface 116 extending between the first and second surfaces 112, 114 about the periphery of the circular body 110.

The circular cavity 120 extends from the body first surface 112 towards the body second surface 114, thereby defining a collar surface 122 substantially parallel with the peripheral surface 116 and an abutment surface 124 substantially perpendicular to the collar surface 122.

The at least one leg 130 of the biasing member 100 extends outward from the body second surface 114. The at least one protruding member 140 preferably extends radially outward from the body peripheral surface 116 and at least substantially from the body first surface 112 to the body second surface 114, thereby effectively extending the first surface 112 radially outward at the protruding member 140.

The biasing member 100 is preferably located within the center portion 40 of the mounting plate 7 with the at least one leg 130 in contact with the mounting plate 7. The body first surface 112 is configured to contact the flux washer 30, and the circular cavity 120 is preferably sized and configured to receive the outward projection 24 of the bobbin 20, with the shoulder portion 25 of the bobbin 20 in contact with the abutment surface 124.

It is preferable that the biasing member 100 comprises an elastomeric material that when assembled, the biasing member 100 is at least minimally compressed and deformed due to contact between the first surface 112 and the mounting flange 3, the abutment surface 124 and the shoulder portion 25, and the at least one leg 130 and the center portion 40. The compression of the biasing member 100 applies a biasing force to the bobbin 20 and to the flux washer 30.

The biasing force provides a solid contact between the flux washer 30 and the outer end surface 52 of the can 17 to promote increased magnetic flux efficiency between the flux washer 30 and the can 17, and the biasing force also maintains the position of the bobbin 20 against the base 18 of the can 17.

The illustrated solenoid 1 is preferably adapted to be fixedly mounted to a frame 13 (FIG. 1) or other common ground with respect to a gasoline engine-driven vehicle or the like, as by a mounting bolt 14 passing through the hole 68 of the ear 8. Either the first or second solenoid coil terminal 6A, 6B is adapted to be connected to the battery positive terminal (not shown) through an ignition starting circuit as by a lead wire 15 while the other solenoid coil terminal 6A, 6B is connected to a ground location (e.g., the frame 13 or battery negative (not shown)). The main power terminals 5 are adapted to be connected in series with the starter motor and the battery, not shown, as by leads 16. The solenoid 1 thus provides a low current control of the high current circuit to the starter motor, not shown, whereby energizing of the coil unit 9 moves the solenoid armature 10 into the solenoid coil unit 9 and the contact assembly 11 bridges and closes the connection of the power terminals 5. This completes the circuit to the starter motor (not shown) in accordance with known ignition systems.

The elastomeric material comprising the biasing member 100 preferably has electrically insulative properties. In a configuration of the solenoid 1 in which the mounting plate 7 is metal and the contact actuation pin 12 is metal, when the solenoid 1 is energized, the entire metal structure will likely become energized. The insulative properties of the biasing member 100 reduce the potential for electricity to pass from the leads 16 (see FIG. 5), through the solenoid 1, through the mounting bracket 7, and to the metal frame 13 or chassis (ground) to which the solenoid 1 is mounted, thus effectively preventing an electrical short in the circuit.

Additionally or alternatively, a method for retaining a coil assembly within a solenoid housing and reducing the potential for electricity to pass through the solenoid to the object on which the solenoid is mounted is contemplated. The method comprises the steps of providing the solenoid 1 comprising a hollow housing 60 with an open end; a coil assembly 9 housed in the housing 60 comprising a cup-shaped can 17, a bobbin 20 with a center tube 21 and an outward projection 24 extending outwardly coaxially from the center tube 21, an armature 10 within the bobbin 20, and a flux washer 30 abutting the open end of the cup-shaped can 17; wherein a portion of the bobbin outward projection 24 extends through the flux washer 30 and beyond the open end of the housing 60; a bridging contact assembly 11 comprising a contact actuation pin 12 and a bridging contact 42 affixed to the contact actuation pin 12 operatively connected to the coil assembly 9 opposite the bobbin outward projection 24; and a mounting plate 3 affixed to the open end of the housing 60.

Further, providing a non-metallic insulative biasing member 100 having a body 110 with a first surface 112, a second surface 114 opposite the first surface 112, a cavity 120 extending inwardly from the first surface 112 towards the second surface 114, and a leg 130 extending outwardly from the body second surface 114.

Further, positioning the bobbin outward projection 24 within the biasing member cavity 120 and positioning the biasing member 100 between the mounting plate 3 and the flux washer 30 with the biasing member leg 130 abutting the mounting plate and the biasing member first surface 112 abutting the flux washer 30.

The biasing member may further comprise a peripheral surface 116 about the periphery of the body 110 between the first surface 112 and the second surface 114 and a protruding member 140 extending outwardly from the peripheral surface 116.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A solenoid unit, the solenoid comprising:

a hollow open-ended housing;

a coil assembly housed in the housing comprising a cup-shaped can, a bobbin with a center tube and an outward projection extending outwardly coaxially from the center tube, an armature within the bobbin, and a flux washer abutting the open end of the cup-shaped can;

at least a portion of the bobbin outward projection extending through the flux washer and beyond the open end of the housing;

a bridging contact assembly comprising a contact actuation pin and a bridging contact affixed to die contact actuation pin operatively connected to the coil assembly opposite the bobbin outward projection;

a mounting plate affixed to the open end of the housing;

an electrically insulative biasing member having a body with a first surface, a second surface opposite the first surface, a cavity extending inwardly from the first surface towards the second surface, and a leg extending outwardly from the body second surface;

the bobbin outward projection received within the biasing member cavity; and the biasing member positioned between the mounting plate and the flux washer with the biasing member leg abutting the mounting plate and the biasing member first surface abutting the flux washer.

2. The solenoid of claim 1, wherein the biasing member has at least two legs extending from the second surface.

3. The solenoid of claim 1, wherein the biasing member has at least three legs extending from the second surface.

4. The solenoid of claim 1, wherein the biasing member is non-metallic.

5. The solenoid of claim 1, wherein the biasing member is elastomeric.

6. The solenoid of claim 1, wherein the biasing member further comprises a peripheral surface about the periphery of the body between the first surface and the second surface and a protrusion extending outwardly from the peripheral surface.

7. The solenoid of claim 6, wherein the biasing member has at least two projections extending from the peripheral surface.

8. The solenoid of claim 6, wherein the biasing member has at least three projections extending from the peripheral surface.

9. The solenoid of claim 1, further comprising a sealing gasket positioned between the mounting plate and the open end of the housing.

10. An improved solenoid unit having a housing; a coil assembly with a can, a bobbin with a center tube and an outward projection, an armature within the bobbin, and a flux washer at the open end of the can; a mounting plate attached to the housing; and a sealing gasket between the housing and the mounting plate, wherein the improvement comprises:

a biasing member having a circular body with a first planar surface, a second planar surface opposite and substantially parallel with the first planar surface, and a peripheral surface extending between the first and second planar surfaces about the periphery of the circular body; a circular cavity extending from the first planar surface towards the second planar surface terminating in an abutment surface and further defining a collar surface about the periphery of the circular cavity; a leg extending outward from the second planar surface; and a protrusion extending radially outward from the body peripheral surface; whereby the first surface extends outward across one end of the protrusion;

whereby the biasing member is positioned with the leg in contact with the mounting plate, the outward projection of the bobbin received within the biasing member circular cavity, the projecting member extending through the sealing gasket, and the first planar surface in contact with the flux washer.

11. The solenoid of claim 10, wherein the biasing member has at least two legs extending from the second surface.

12. The solenoid of claim 10, wherein the biasing member has at least three legs extending from the second surface.

13. The solenoid of claim 10, wherein the biasing member is non-metallic.

14. The solenoid of claim 10, wherein the biasing member is electrically insulative.

15. The solenoid of claim 10, wherein the biasing member has at least two projections extending from the peripheral surface.

16. The solenoid of claim 10, wherein the biasing member has at least three projections extending from the peripheral surface.

17. A method for retaining a coil assembly within a solenoid housing and reducing the potential for electricity to pass through the solenoid to the object on which the solenoid is mounted, the method comprising the steps of;

providing a solenoid haying a hollow housing with an open end; a coil assembly housed in the housing comprising a cup-shaped can, a bobbin with a center tube and an outward projection extending outwardly coaxially from the center tube, an armature within the bobbin, and a flux washer abutting the open end of the cup-shaped can; wherein a portion of the bobbin outward projection extends through the flux washer and beyond the open end of the housing; a bridging contact assembly comprising a contact actuation pin and a bridging contact affixed to the contact actuation pin operatively connected to the coil assembly opposite the bobbin outward projection; and a mounting plate affixed to the open end of the housing;

providing a non-metallic insulative biasing member having a body with a first surface, a second surface opposite the first surface, a cavity extending inwardly from the first surface towards the second surface, and a leg extending outwardly from the body second surface;

positioning the bobbin outward projection within the biasing member cavity; and positioning the biasing Member between the mounting plate and the flux washer with the biasing member leg abutting the mounting plate and the biasing member first surface abutting the flux washer.

18. The method of claim 17, wherein the biasing member further comprises a peripheral surface about the periphery of the body between the first surface and the second surface and a protrusion extending outwardly from the peripheral surface.

19. The method of claim 17, wherein the biasing member has at least two legs extending from the second surface.

20. The method of claim 18 wherein the biasing member has at least two projections extending from the peripheral surface.

* * * * *